United States Patent [19]

Frostig

[11] 4,388,868

[45] Jun. 21, 1983

[54] SHELL BODY FOR FIN-STABILIZED PROJECTILES

[75] Inventor: Amos Frostig, Haifa, Israel

[73] Assignee: Etablissement Salgad, Liechtenstein

[21] Appl. No.: 205,212

[22] Filed: Nov. 10, 1980

[51] Int. Cl.[3] ..... F42B 13/02

[52] U.S. Cl. ..... 102/473; 102/372; 102/374; 102/501

[58] Field of Search ..... 102/372, 373, 374, 473, 102/474, 485, 501

[56] References Cited

U.S. PATENT DOCUMENTS

| | | | |
|---|---|---|---|
| 2,037,308 | 4/1936 | Brandt | 102/373 |
| 2,070,946 | 2/1937 | Joyce | 102/373 |
| 3,343,488 | 9/1967 | Sherwood | 102/372 X |
| 3,882,779 | 5/1975 | Frostig | 102/372 X |
| 4,109,579 | 8/1978 | Carter | 102/373 X |
| 4,223,606 | 9/1980 | Bornstein | 102/374 |
| 4,301,737 | 11/1981 | Yuhash et al. | 102/493 X |

FOREIGN PATENT DOCUMENTS

| | | | |
|---|---|---|---|
| 228092 | 6/1963 | Austria | 102/373 |

*Primary Examiner*—Peter A. Nelson
*Attorney, Agent, or Firm*—Neil F. Markva

[57] ABSTRACT

A shell body for fin-stabilized projectiles has an ogival curvature and is composed of two body sections. A front body section has a cylindrical bore extending therethrough and a rear body portion has a cavity therein. A headpiece containing a fuse is connected to the front end of the front body section and a tail tube with a fin-stabilizer unit is connected to the rear of the rear body section.

10 Claims, 1 Drawing Figure

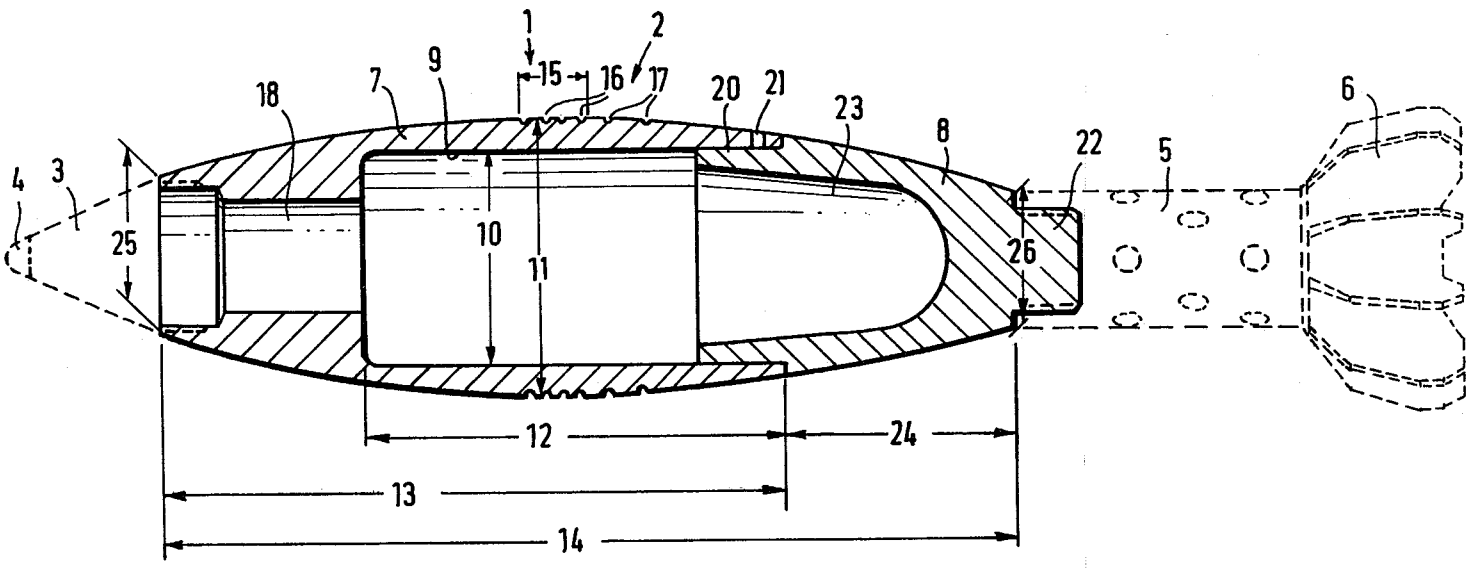
6
5
22
26
8
23
21
20
2
17
16
15
1
9
7
18
4
3
25
10
11
12
13
14
24

SHELL BODY FOR FIN-STABILIZED PROJECTILES

FIELD OF THE INVENTION

This invention relates to a shell body for fin-stabilized projectiles. More particularly, the invention relates to a shell body having a front end formed to receive a headpiece containing a fuse and a rear end formed to receive a tail tube with a fin-stabilizer unit.

BACKGROUND OF THE INVENTION

Known mortar shells have constructions including a maximum diameter zone from which the outer surface thereof conically tapers toward the front and the rear with an ogival curvature. These prior art shells include two sections which meet at approximately the point of maximum diameter along the outside surface of the shell body. The internal shape of these known body sections correspond more or less exactly to the external shape. In other words, they are tapered toward both the rear and front of the body section. This configuration requires extensive and costly machining operations.

Furthermore, known fin-stabilized mortar shells of ogival form have an inner hollow space which is cylindrical at the center of the shell body length. The single piece shell body is again contracted at its rear portion and is formed by suitable pressure forging of the material from which it is constructed. The wall of the rear body section is correspondingly weakened when using such a manufacturing procedure. Furthermore, the rear aperture, which has been left free to receive the tail tube, has a relatively small diameter. Thus, a charge content which is essentially pourable must be used to completely fill the inner hollow space of the shell body.

SUMMARY OF THE INVENTION

The primary object of this invention is to provide a shell body for fin-stabilized projectiles wherein the shell body is constructed to be manufactured in the most efficient manner and to achieve assembly and loading characteristics heretofore unavailable with prior art shell bodies of the type mentioned.

The shell body for fin-stabilized projectiles as described herein includes a front body section and a rear body section which are joined at a point which is approximately one-quarter of the body length as measured from one end thereof. An inner cylindrical bore is located within the front body section and unrestrictedly terminates at the rear end of the front body section. The rear body section includes an extension means which engages the cylindrical bore of the front body section. The cylindrical bore has a diameter of about 0.75 to about 0.82 times the caliber diameter of the shell body. More specifically, the cylindrical bore has a diameter of about 0.80 times the caliber diameter. The cylindrical bore has a length of about 0.65 to 0.70 times the length of the front body section. Such a diameter in length of the cylindrical bore provides an extremely large filling space into which a pre-prepared filing charge content may be disposed.

According to another feature of the invention, the center of the maximum diameter zone which is equal to the caliber diameter is located at a point approximately 0.4 to 0.5 times the total shell body length from the front of the shell body. The resultant shell body has an ogival form which tapers forwardly and rearwardly. The ogival form is such that the diameter of the front end face of the front body section and the diameter of the rear end face of the rear body section are approximatelly equal and may correspond approximately to one-half times the caliber diameter. The ogival form of the fin-stabilized projectile of this invention has a good external ballistic quality. The pre-prepared, insertable charge used in conjunction with the shell body contributes to the achievement of the correct pendulum movement of the shell, thereby resulting in increased accuracy.

The front end of the front body section may include a through-going bore which communicates with the cylindrical bore therein. The rear end of the rear body section is closed. A plug-like extension having a threaded outer surface may be used to floodingly engage the tail tube unit. A cavity located in the rear body section may have a depth which corresponds approximately to one-half the length of the exposed outer surface of the rear body section. This cavity constitutes an open, easily accessible filling space located in the rear body section.

BRIEF DESCRIPTION OF THE DRAWING

The invention will now be described with reference to an embodiment thereof illustrated in the drawing. The only FIGURE shows a longitudinal sectional view through an embodiment of a shell body for fin-stabilized projectiles made in accordance with this invention.

DETAILED DESCRIPTION

The fin-stabilized projectile, generally designated 1, has a shell body 2 which tapers in an ogival curve toward the front and the rear thereof. A headpiece 3 is located at the front of shell body 2 and is fitted with a fuse 4. A tail tube 5 is located at the rear end of shell body 2 and receives a propellent charge (not shown) and a fin-stabilizer unit 6.

Shell body 2 includes a front body section 7 and a rear body section 8. Body section 7 and 8 are joined in the rear portion of shell body 2 at a point approximately one-quarter of the length from the rear end face 26 of shell body 2. Front body section has an inner, cylindrical bore 9 which unrestrictedly terminates or opens outwardly at the rear end of body section 7. Bore 9 has a constant, unaltered diameter over its entire length thereof. Cylindrical bore 9 includes a diameter 10 that is approximately 0.75 to 0.82 times the caliber diameter 11 of shell body 2. Bore 9 has a length 12 which is about 0.65 to 0.70 times the length of the front body section 7.

The center of the maximum diameter zone 15 is located at a point approximately 0.4 to 0.5 times the total length 14 of shell body 2 as measured from the front end surface 25 of shell body 2. Annular grooves 16 are located on the outer surface of front body section 7 within the maximum diameter zone 15. Further annular grooves 17 are also located on the already somewhat inclined portion of the front body section 7. Through-going bore 18 located in the front body section 7 receives the fuse charge and is in communication with cylindrical bore 9. A charge of suitable nature, e.g., a tracer composition or the like, may be disposed in cylindrical bore 9.

A sleeve-like cylindrical extension 20 of rear body section 8 is constructed as a complementary portion for cylindrical bore 9. As is evident from the description and drawings, extension 20 is slip fit joined into the cylindrical bore 9. The radially extending bores 21 receives pins or the like as an additional means of securing rear body section 8 to front body section 7. The rear end of body section 8 is of closed construction and has a threaded extension 22 onto which tail tube 5 is screwed. A cavity 23 in rear body section 8 has a depth which corresponds approximately to one-half times the length 24 of the outer exposed surface of body section 8. The interior of sleeve-like extension 20 may be basically cylindrical.

The ogival curvature of shell body 2 tapers toward the front and rear so that the diameter 25 of the front end surface of front body section 7 and the diameter 26 of the rear end face of rear body section 8 are approximately equal. These end surface diameters 25 and 26 are approximately one-half times the caliber diameter of the shell body 2. In this particular embodiment, shell body 2 is formed of steel.

ADVANTAGES OF THE INVENTION

The construction of a shell body for fin-stabilized projectiles as described and disclosed herein has several favorable advantages. The shell body 2 being divided at a location at least three-quarters times the length from the front end of the front section 7 produces a cylindrical hollow space or bore 9 having a considerable length and width. The cylindrical bore 9 which terminates in an unrestricted manner at the rear of front body section 7 is produced without any narrowing. Thus, the charge content can be pre-prepared, ready for use, and easily inserted into bore 9. The resulting cylindrical hollow space or bore 9 is large. Consequently, a large, voluminous charge pack, e.g., tracer composition, explosive composition or the like, may be easily inserted into bore 9.

The unrestricted termination of internal cylindrical bore 9 has a further advantage in that the hollow rear shell body section 8 may be inserted into cylindrical bore 9 with a complementary cylindrical extension 20 having a diameter substantially equal to the inner diameter of cylindrical bore 9. Thus, body section 8 sits safely and reliably into section 7. Additional securing means may be used to effect the connection between the shell body section 7 and 8. Such additional securing means may consist of radially directed screws extending through the wall of front section 8 and contacting the extension 20 as shown in the drawing.

While the Shell Body for Fin-Stabilized Projectiles has been shown and described in detail, it is obvious that this invention is not to be considered as being limited to the exact form disclosed, and that changes in detail and construction may be made therein within the scope of the invention, without departing from the spirit thereof.

I claim:

1. A shell body for fin-stabilized projectiles, said body having an ogival curvature and adapted to receive a headpiece containing a fuse at the front end thereof and to receive a tail tube with fin-stabilizer unit at the rear end thereof, said shell body comprising:

(a) a front body section and a rear body section slip fit joined to each other at a point approximately one-quarter of the body length as measured from one end thereof starting at the beginning of the tail tube, (b) an inner cylindrical bore is located within the front body section and has a surface unrestrictedly terminating at the rear of the frong body section to form an opening for receiving a charge, (c) the rear body section includes an extension means which is complementary to and slidingly engages the cylindrical bore surface of the front body section.

2. A shell body as defined in claim 1 wherein the cylindrical bore has a diameter equal to about 0.75 to 0.82 times the caliber diameter of the shell body.

3. A shell body as defined in claim 2 wherein the cylindrical bore has a diameter of about 0.80 times the caliber diameter of the shell body.

4. A shell body as defined in claim 1 or 2 wherein the cylindrical bore has a length which is approximately 0.65 to 0.70 times the length of the front body section.

5. A shell body as defined in either of the claims 1, 2 or 3 wherein the center of the maximum diameter zone is located at a point about 0.4 to 0.5 times the total length of the shell body.

6. A shell body as defined in any of the claims 1, 2 or 3 wherein the front body section includes a through-going bore extending from the front end thereof to said cylindrical bore.

7. A shell body as defined in any one of claims 1, 2 or 3 wherein the rear body section includes a cavity which tapers inwardly toward the rear of the shell body and has a depth which corresponds approximately one-half times the length of the outer exposed surface of the rear body section.

8. A shell body as defined in any one of the claims 1, 2 or 3 wherein the extension means has an exterior surface which is cylindrical and slidingly engages with the cylindrical bore and has an interior surface which is basically cylindrical.

9. A shell body as defined in any one of claims 1, 2 and 3 wherein the rear body section includes a threaded extension onto which the tail tube is screwed.

10. A shell body as defined in any one of claims 1, 2 and 3 wherein the diameter of the front end surface of the front body section and the diameter of the rear end surface of the rear body section are approximately equal, said front and rear end surface diameters are approximately one-half times the caliber diameter.

* * * * *